US006715438B1

(12) United States Patent
Hundertmark

(10) Patent No.: US 6,715,438 B1
(45) Date of Patent: Apr. 6, 2004

(54) TILLER OPERATED POWER ASSIST MARINE STEERING SYSTEM

(75) Inventor: James M. Hundertmark, Fond du Lac, WI (US)

(73) Assignee: Mark X Steering Systems, LLC, Oshkosh, WI (US)

( * ) Notice: Subject to any disclaimer, the term of this patent is extended or adjusted under 35 U.S.C. 154(b) by 0 days.

(21) Appl. No.: 10/271,227

(22) Filed: Oct. 15, 2002

(51) Int. Cl.[7] ..... B63H 25/00
(52) U.S. Cl. ..... 114/144 R; 440/61 R
(58) Field of Search ..... 440/61 R, 61 S, 440/61 A, 61 B, 61 C; 114/144 R

(56) References Cited

U.S. PATENT DOCUMENTS

| | | | |
|---|---|---|---|
| 2,543,553 A | | 2/1951 | McAllister |
| 3,174,357 A | | 3/1965 | Conklin |
| 3,613,624 A | | 10/1971 | Stauffer |
| 3,990,385 A | | 11/1976 | Adams |
| 4,496,326 A | | 1/1985 | Boda |
| 5,046,974 A | | 9/1991 | Griffin, Jr. et al. |
| 5,145,427 A | | 9/1992 | Kawai et al. |
| 5,176,549 A | | 1/1993 | Ross |
| 5,180,320 A | | 1/1993 | Calamia et al. |
| 5,279,242 A | | 1/1994 | Johnson |
| 5,340,342 A | | 8/1994 | Boda et al. |
| 5,378,178 A | | 1/1995 | Haman |
| 5,421,755 A | | 6/1995 | Kakizaki |
| 5,444,979 A | * | 8/1995 | Funami et al. ..... 60/460 |
| 5,632,216 A | | 5/1997 | Hair |
| 5,797,777 A | | 8/1998 | Tsunekawa et al. |
| 6,352,456 B1 | | 3/2002 | Jaszewski et al. |

* cited by examiner

*Primary Examiner*—Jesus D. Sotelo
(74) *Attorney, Agent, or Firm*—Boyle Fredrickson Newholm Stein & Gratz S.C.

(57) ABSTRACT

A tiller is preferably coupled to the outboard motor or other steered element of a watercraft such that movement of the tiller in a first manner imposes manually-generated steering forces on the steered element and that operation of the tiller in a second manner imposes power assist steering forces on the steered element. The first manner preferably involves movement of the tiller as a whole, in which case tiller movement drives the steered element mechanically. The second manner preferably involves movement of an actuator portion of the tiller relative to the remainder of the tiller, in which case movement of the tiller actuator portion causes a steering cylinder assembly, an electric stepper motor, or other drive mechanism to impose power assist steering forces on the steered element. The actuator portion of the tiller may, for example, comprise an articulating end of the tiller's arm or a throttle grip supported on the tiller.

34 Claims, 10 Drawing Sheets

TILLER OPERATED POWER ASSIST MARINE STEERING SYSTEM

BACKGROUND OF THE INVENTION

1. Field of the Invention

The invention relates to marine steering systems and, more particularly, relates to a steering system for a boat or other watercraft that is powered by a motor and steered with a tiller. Specifically, the system includes a tiller-operated power assist steering system that imposes steering forces on the watercraft's motor or other steered element upon tiller actuation.

2. Discussion of the Related Art

In one type of conventional marine steering system, a watercraft such as a boat is steered by pivoting an outboard motor on the stern of the watercraft about a vertical steering axis under control of an operator. The steering forces are typically generated manually using a tiller that is located at the stem of the boat and that is connected to the motor either directly or indirectly via a mechanical steering linkage.

Manually operated tillers of the type described above are very effective for steering boats equipped with small and mid-sized outboard motors. However, they exhibit some drawbacks and disadvantages, particularly in applications equipped with relatively large motors. For instance, the forces required to steer the boat increase at least generally proportionately with motor size. Relatively large outboard motors, i.e., 150 horsepower motors and larger, can therefore be difficult to steer manually using a standard tiller. In fact, a 225 horsepower motor would typically require a tiller that is 4' to 5' long to permit comfortable manual steering. Tillers of that length are not practical in most boats. Relatively large outboard motors therefore are typically steered using power assist steering systems controlled by a steering wheel located at the helm of the boat rather than by using a tiller located at the stem of the boat. This remote steering requirement adds considerable cost and complexity to the typical boat.

Another problem associated with the typical tiller steered boat is that reaction forces are imposed on and by the motor during its operation that cause the steering angle to change unless the reaction forces are countered by the operator. The operator must therefore retain control of the tiller at all times in order to maintain a desired heading. The operator's freedom of movement therefore is sharply curtailed. In addition, the reaction forces, like the steering forces, increase generally proportionately with motor size. The relatively large reaction forces imposed on and by larger motors require commensurately larger retention forces by the operator, leading to operator fatigue over time.

The need therefore has arisen to provide a tiller operated power assist steering system that reduces the level of effort required by an operator to steer a boat or other watercraft.

The need has additionally arisen to provide a tiller operated power assist steering system that maintains a steering angle against reaction forces on or by the steered element, thereby negating the need for the operator to constantly man the tiller.

SUMMARY OF THE INVENTION

In accordance with a first aspect of the invention, a power assist steering assist system for a tiller-steerable watercraft includes a tiller which is configured to be operatively coupled to the steered element, an actuator, and a drive mechanism such that tiller movement effects actuation of the drive mechanism to impose power-assisted steering forces on the steered element. Preferably, the tiller is also mechanically or otherwise operatively coupled to the steered element so as to impose manually-generated steering forces on the steered element upon manipulation of the tiller in a first manner and to effect actuation of the drive mechanism to impose power-assisted steering forces on the steered element upon tiller manipulation in a second manner.

The tiller preferably comprises an actuator portion which is movable relative to the remainder of the tiller. In this case, the tiller cooperates with the actuator and is configured to cooperate with the steered element such that the tiller operates in the first manner when the tiller moves as a unit and operates in the second manner when the actuator portion moves relative to the remainder of the tiller. The actuator portion may, for example, be an articulating outer end portion of a tiller arm of the tiller or a movable throttle grip mounted on the tiller.

The steering system may be a hydraulic power assist steering system, in which case the drive mechanism preferably comprises an unbalanced steering cylinder assembly and the actuator comprises a hydraulic actuator that will typically include a control valve assembly that is controlled by operation of the tiller in the first manner to control the flow of hydraulic fluid to and form the steering cylinder assembly. The hydraulic actuator preferably comprises a control valve assembly that is mechanically coupled to the actuator portion of the tiller so as to control fluid flow between the steering cylinder and a pump and between the steering cylinder and a reservoir in response to movement of the actuator portion of the tiller relative to the remainder of the tiller.

Regardless of the drive mechanism and actuator employed, a biasing arrangement preferably is provided in the tiller to bias the actuator portion to a neutral position in which the drive mechanism is locked, e.g., through the closure of valves controlling hydraulic fluid flow to and from a steering cylinder. This locking resists steered element movement which could otherwise occur through the imposition of reaction forces on or by the motor, permitting the operator to release the tiller and perform other activities.

In accordance with another aspect of the invention, a method of steering a watercraft comprises moving a first portion of a tiller relative to a second portion of the tiller to operate a drive mechanism so as to impose power assist steering forces on a steered element of a watercraft. In order to permit manual steering to supplement the power assist steering forces or to substitute for those forces in the event of failure of the power assist steering system, the method preferably further comprises moving the first and second portions of the tiller as a unit to impose manually-generated steering forces on the steered element.

The moving step resulting in the imposition of hydraulic assist steering forces may comprise pivoting an outer portion of a tiller arm of the tiller relative to an inner portion of the tiller arm. Alternatively, it may comprise pivoting a throttle shaft of the tiller relative to a tiller arm on which the throttle shaft is mounted. In either event, the power steering forces may be hydraulically-generated power assist steering forces imposed on the steered element by directing hydraulic fluid to and from a steering cylinder assembly which is mechanically coupled to the steered element. These hydraulically generated steering forces may be generated using pressurized hydraulic fluid.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. System Overview

Figure 1:
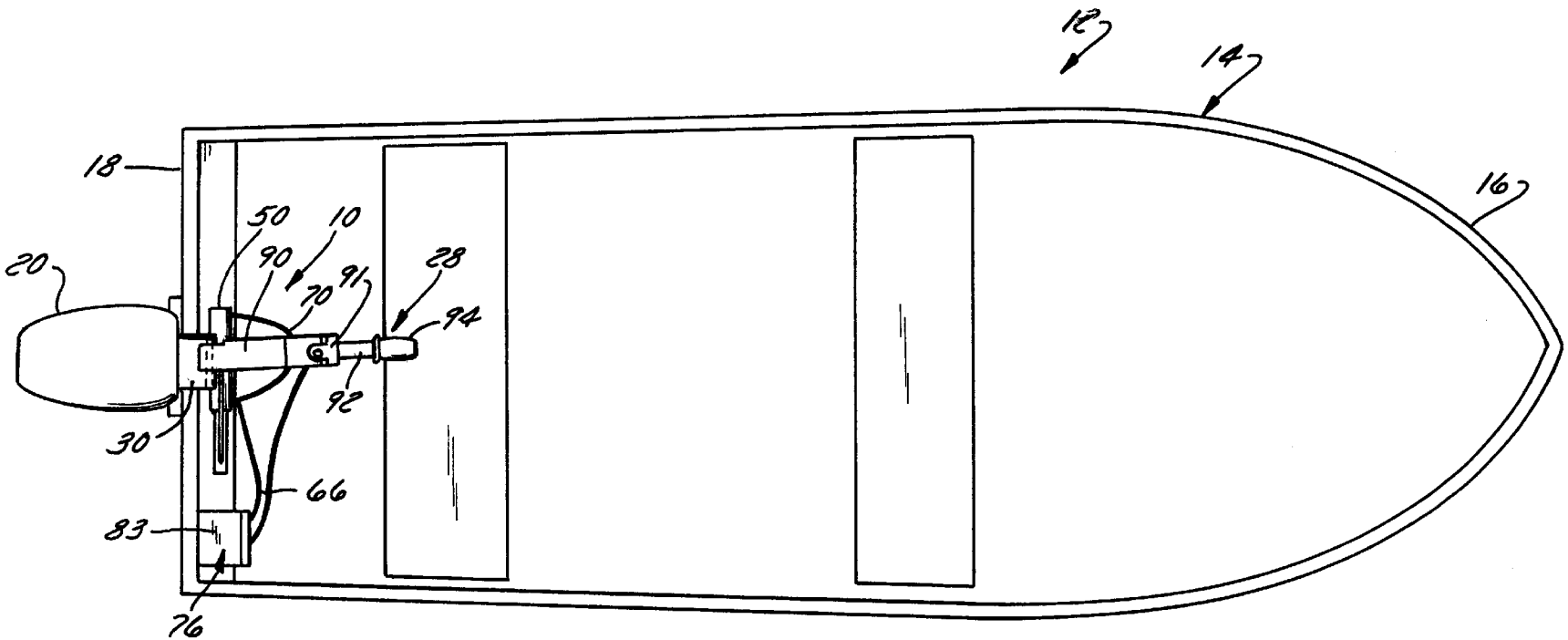
FIG. 1 is a schematic top plan view of a boat incorporating a tiller-operated power-assist steering system constructed in accordance with a first preferred embodiment of the present invention.
Figure 2:
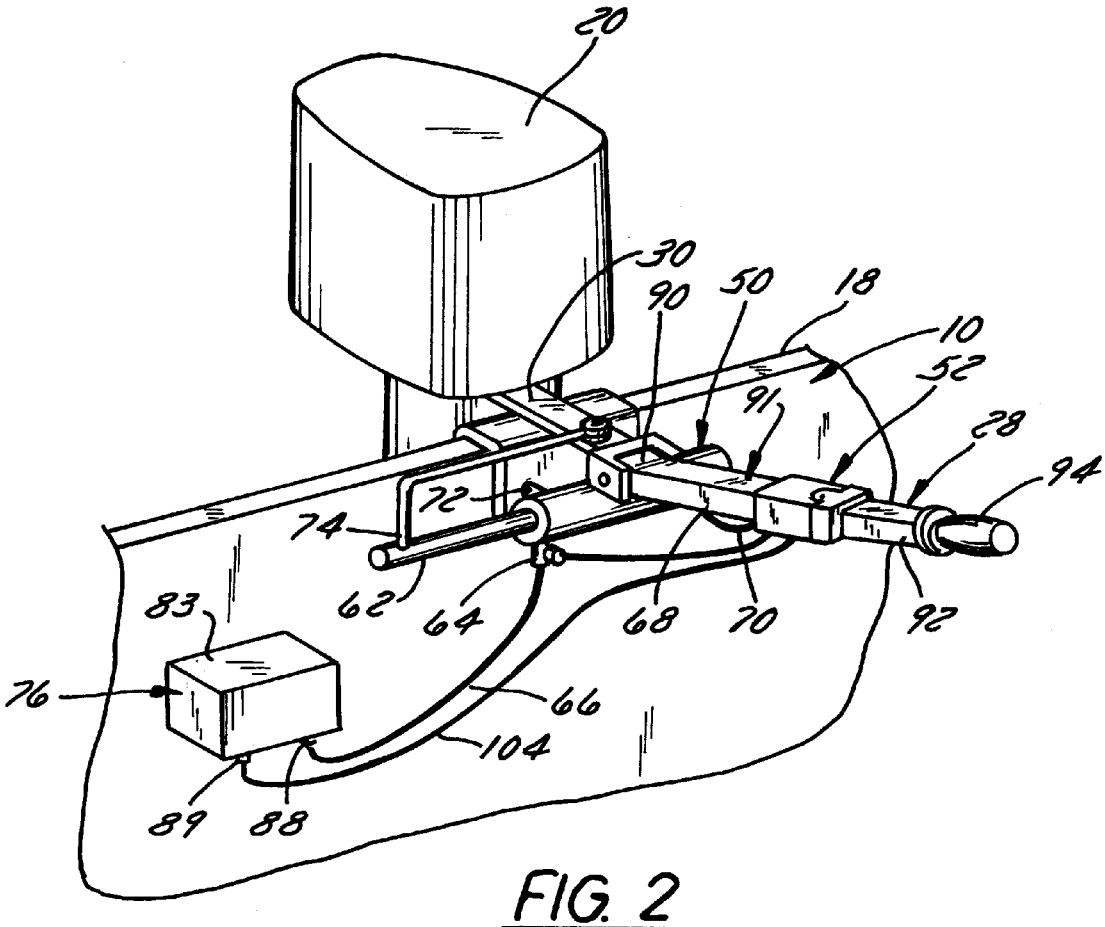
FIG. 2 is perspective view of the steering system of FIG. 1 and of the surrounding portion of the boat.
Figure 3:
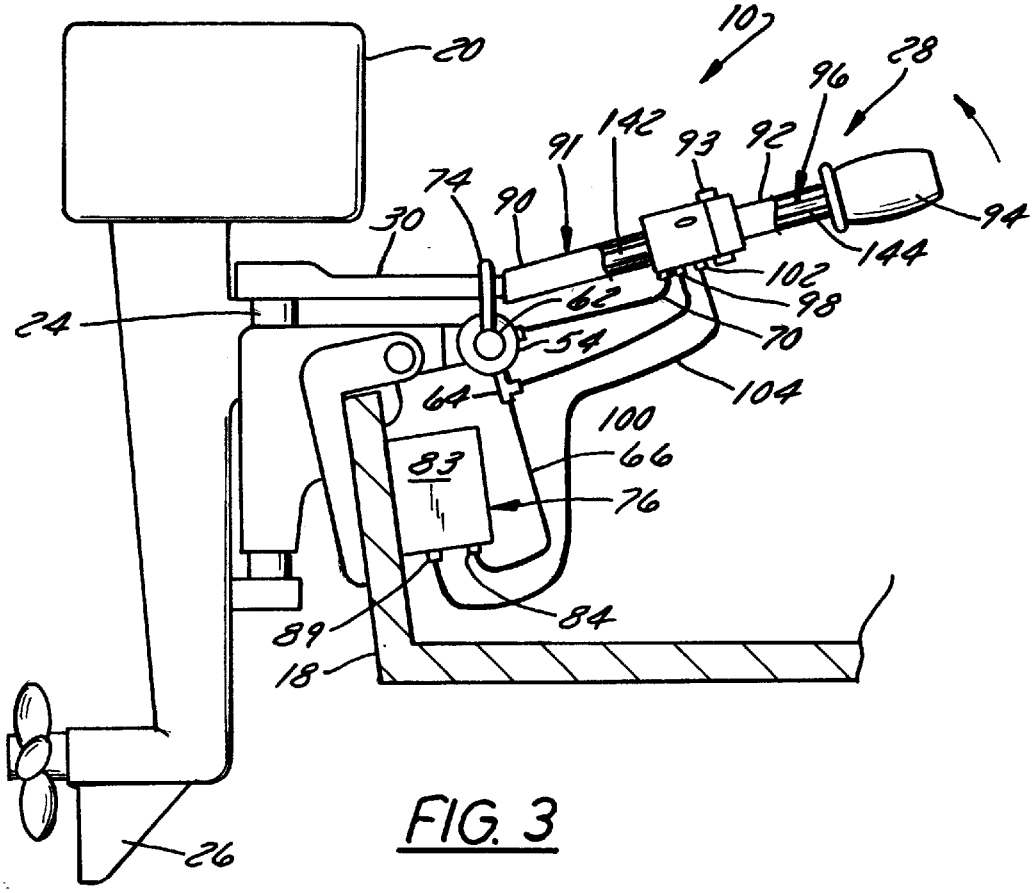
FIG. 3 is an elevation view of the portion of the boat illustrated in FIG. 2.

Turning now to the drawings and initially to FIGS. 1–3, a boat 12 is illustrated that incorporates a tiller-operated power assist steering system constructed in accordance with a preferred embodiment of the present invention. The boat 12 includes a hull 14 having a bow 16 and a stern 18, and an outboard motor 20 mounted on the stern 18. As is conventional, the motor 20 is mounted on the boat 12 by a pivoting mount assembly 24 that permits the motor 20 to be pivoted about a generally vertical steering axis to cause a rudder 26 on the motor 20 to steer the boat 12. The motor 20 could alternatively be a non-pivoting inboard or outboard motor, and the boat 12 or other watercraft could be steered by one or more rudders located either on or remote from the motor 20.

Steering forces are transmitted to the motor 20 by a tiller 28 coupled to the motor by a linkage 30 that causes the motor to swing about its pivot axis when steering forces are applied to the tiller. The tiller 28 preferably is coupled to the steering linkage 30 such that movement of the tiller 28 in a first manner imposes manually-generated steering forces on the steering linkage 30 and that operation of the tiller 28 in a second manner imposes power assist steering forces on the steering linkage 30. It is conceivable, however, that the linkage 30 could be eliminated and that the tiller 28 could be operatively coupled to the motor 20 by a cable arrangement or some other structure permitting the tiller 28 to be located remote from the motor 20. The tiller 28 could also be mounted directly on or formed integrally with the motor 20.

Depending on the application and designer preference, the first and second manners may be either exclusive or non-exclusive. The first manner preferably involves movement of the tiller 28 as a whole, in which case tiller movement drives the steering linkage mechanically. The second manner preferably involves movement of an actuator portion of the tiller relative to the remainder of the tiller, in which case movement of an actuator portion of the tiller causes a steering cylinder assembly, an electric stepper motor, or other drive mechanism to impose power assist steering forces on the steering linkage. The actuator portion may, for example, comprise an articulating end of the tiller's arm or a throttle grip supported on the tiller. If the drive mechanism is a steering cylinder assembly powered by hydraulic fluid flow, the hydraulic fluid may be pressurized by a pressure source to provide powered hydraulic power assist steering. Two exemplary pressurized hydraulic power assist steering systems will now be described by way of non-limiting examples of power assist steering systems constructed in accordance with the invention.

2. Construction and Operation of First Embodiment

Referring initially to FIGS. 1–4, the power assist steering system 10 constructed in accordance with a first embodiment of the invention, as applied to the boat 12 described above, is a pressurized hydraulic power assist steering system. It includes the tiller 28, a drive mechanism in the form of a steering cylinder assembly 50, and a hydraulic actuator 52 that is connected to the steering cylinder assembly 50 and to the tiller 28. The hydraulic actuator 52, steering cylinder assembly 50, and tiller 28 are interconnected such that, upon movement of an actuator portion of the tiller 28 relative to the remainder of the tiller, the steering cylinder assembly 50 is actuated by pressurized hydraulic fluid to impose hydraulically generated steering forces on the motor 20 through the steering linkage 30. The steering cylinder assembly 50, hydraulic actuator 52, and tiller 28 will now be described in turn.

Figure 4:
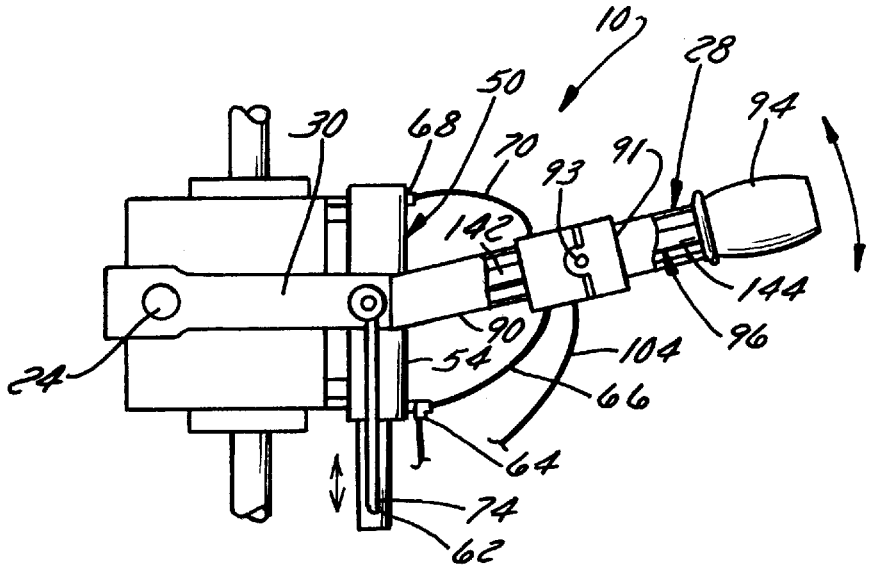
FIG. 4 is top plan view of the steering system of FIGS. 2 and 3.
Figure 5:
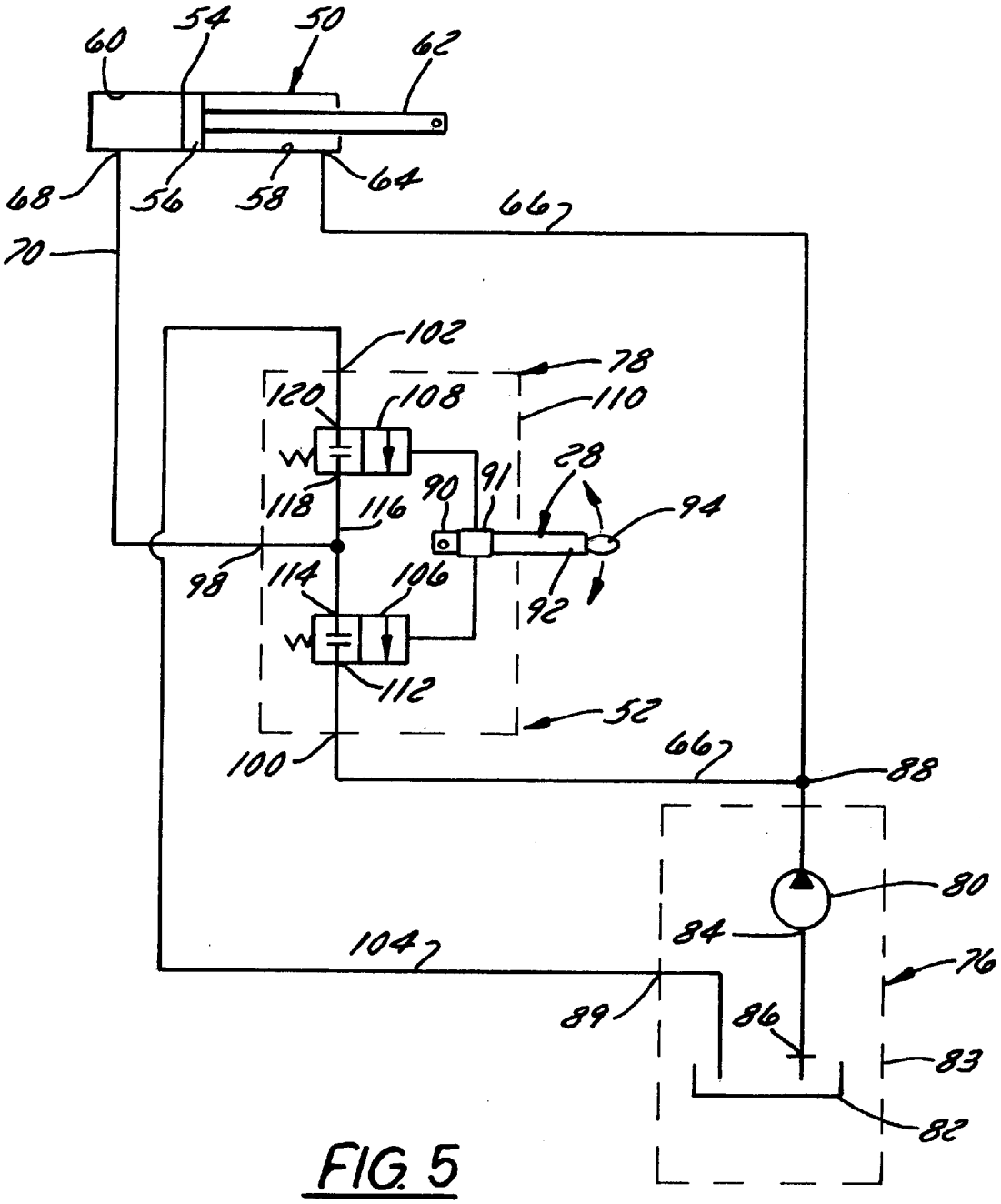
FIG. 5 is a hydraulic circuit schematic illustrating the construction and operation of the hydraulic components of the hydraulic assist steering system of FIGS. 2–4.
Figure 6:
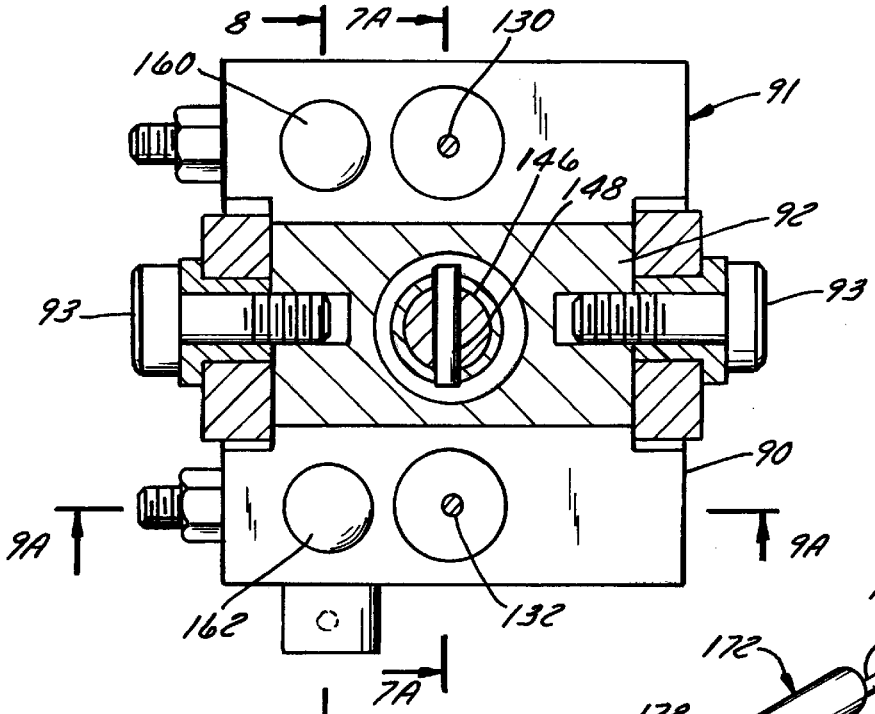
FIG. 6 is a sectional end view of a portion of a tiller of the steering system of FIGS. 2–4 that includes a hydraulic actuator of the steering system.

Referring to FIGS. 2–5, the steering cylinder assembly 50 comprises a hydraulically actuated, unbalanced steering cylinder assembly. "Unbalanced" as used herein means that the cylinder assembly's piston has different effective surface areas on opposite sides thereof such that equal fluid pressures on both sides of the piston generate an intensification effect on the side of the piston having a greater effective surface area and drive the piston to move towards the side of the cylinder facing the side of the piston having a smaller effective surface area. Referring to FIG. 5 in particular, the steering cylinder assembly 50 includes a steering cylinder 54, a steering piston 56 mounted in the steering cylinder 54 to form first and second chambers 58 and 60 on opposite sides of the steering piston 56, and a rod 62 connected to the steering piston 56. A first port 64 opens into the first chamber 58 for connection to a high pressure line 66. A second port 68 opens into the second chamber 60 for connection to a metering line 70. As best seen in FIG. 2, the steering cylinder 54 of this embodiment is a stationary cylinder mounted on the stern 18 of the hull 14 by a suitable bracket 72. The rod 62 extends axially through a rod end of the steering cylinder (disposed opposite a cylinder end) and terminates at a free end that is coupled to the steering linkage 30 by a link 74. The unbalanced condition of the steering cylinder assembly 50 therefore is created by virtue of the attachment of the rod 62 to only one side of the steering piston 56 and the consequent reduction in piston surface area exposed to fluid pressure in the first chamber 60. Alternatively, the rod 62 could extend completely through the steering cylinder 54 and could be affixed to a stationary support 72, in which case the steering cylinder 54 would be coupled to the steering linkage 30 and would reciprocate relative to the stationary piston. In this case, the unbalanced condition of the steering cylinder assembly 50 would be achieved by other measures, e.g., by making one end of the steering rod diametrically smaller than the other.

The hydraulic actuator 52 could comprise any structure or assembly capable of controlling fluid flow to and from the steering cylinder assembly 50 under the operation of the actuator portion of the tiller 28. In the illustrated embodiment, hydraulic actuator 52 is a pressurized actuator located at the stem of the boat 12. It comprises a control valve assembly hydraulically coupled to a pressure source 76 and to the steering cylinder assembly 50. The pressure source 76 preferably comprises a pump 80 and reservoir 82 contained in a common casing 83 best seen in the assembly illustrated in FIGS. 2 and 5. The pump 80 has an inlet 84 connected to an outlet 86 of the reservoir 82 and an outlet 88 connected to or forming the pressurized outlet of the pressure source 76. The reservoir 82 has a low pressure inlet 89 connected to or forming the inlet port of the pressure source 76. An accumulator (not shown) could be provided between the pump outlet 88 and the tiller 28, if desired.

Referring now to FIGS. 2–4, the tiller 28 of this embodiment includes an articulating tiller arm 91. Tiller arm 91 has an inner portion 90 that is affixed to the steering linkage 30 and an outer portion 92 that is bolted to the inner portion 90 by bolts 93 so as to be pivotable through a limited stroke relative to the inner portion 90 about a vertical pivot axis. The outer portion 92 of the tiller arm 91 terminates in a grip 94 that may be stationery relative to the tiller arm 91, but preferably comprises a twist grip supported on a throttle shaft 96 extending axially through the tiller arm 91. The articulating outer portion 92 of the tiller arm 91 forms the actuator portion of the tiller 28 of this embodiment. The entire tiller 28 can also pivot about a horizontal pivot axis to move it in the direction of the arrow in FIG. 3 so as to permit selective stowing of the tiller 28.

Figure 7A:
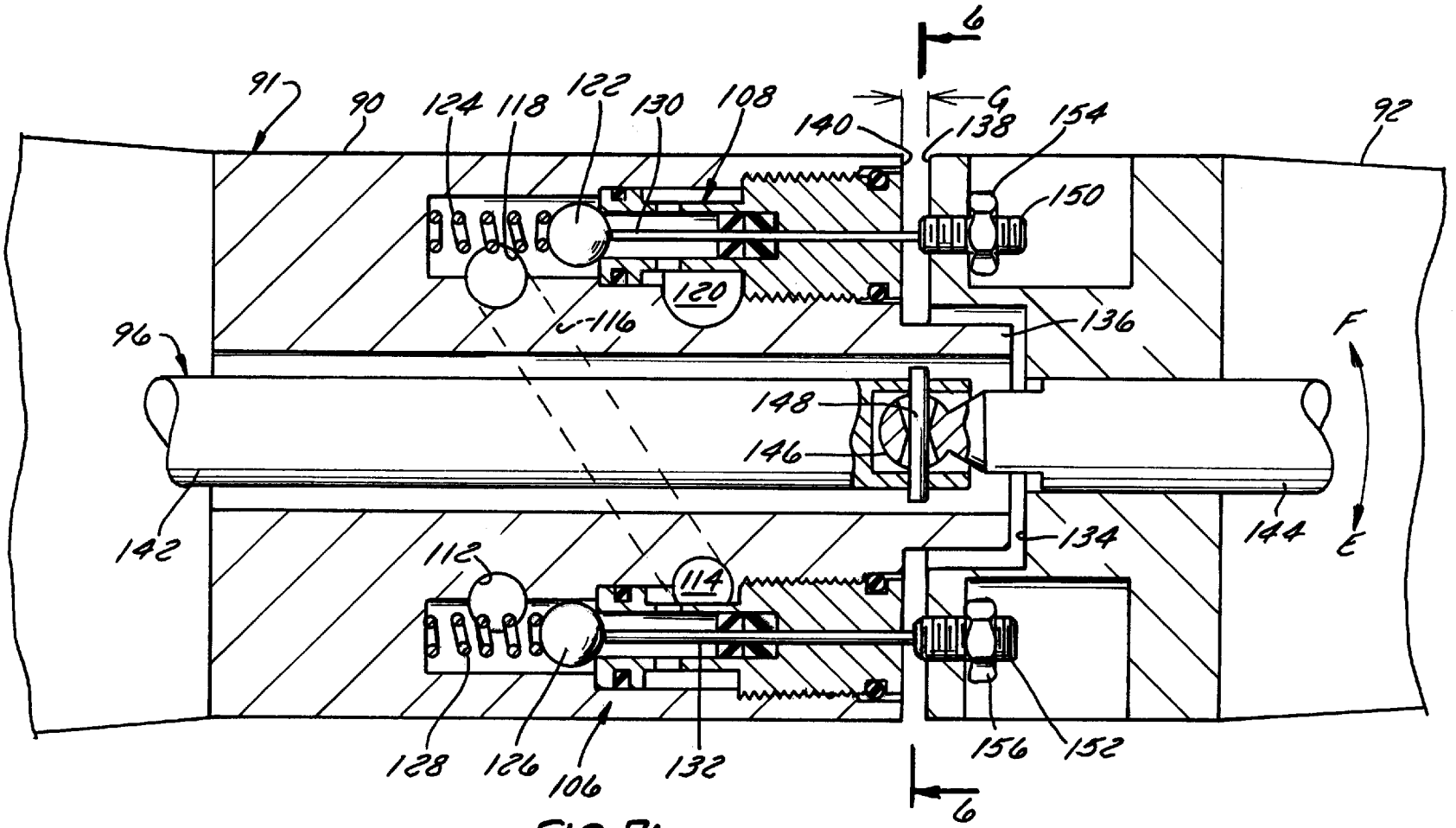
FIG. 7A is a sectional plan elevation view taken generally along the lines 7A—7A in FIG. 6 and illustrating the hydraulic actuator in a first operational position thereof.
Figure 7B:
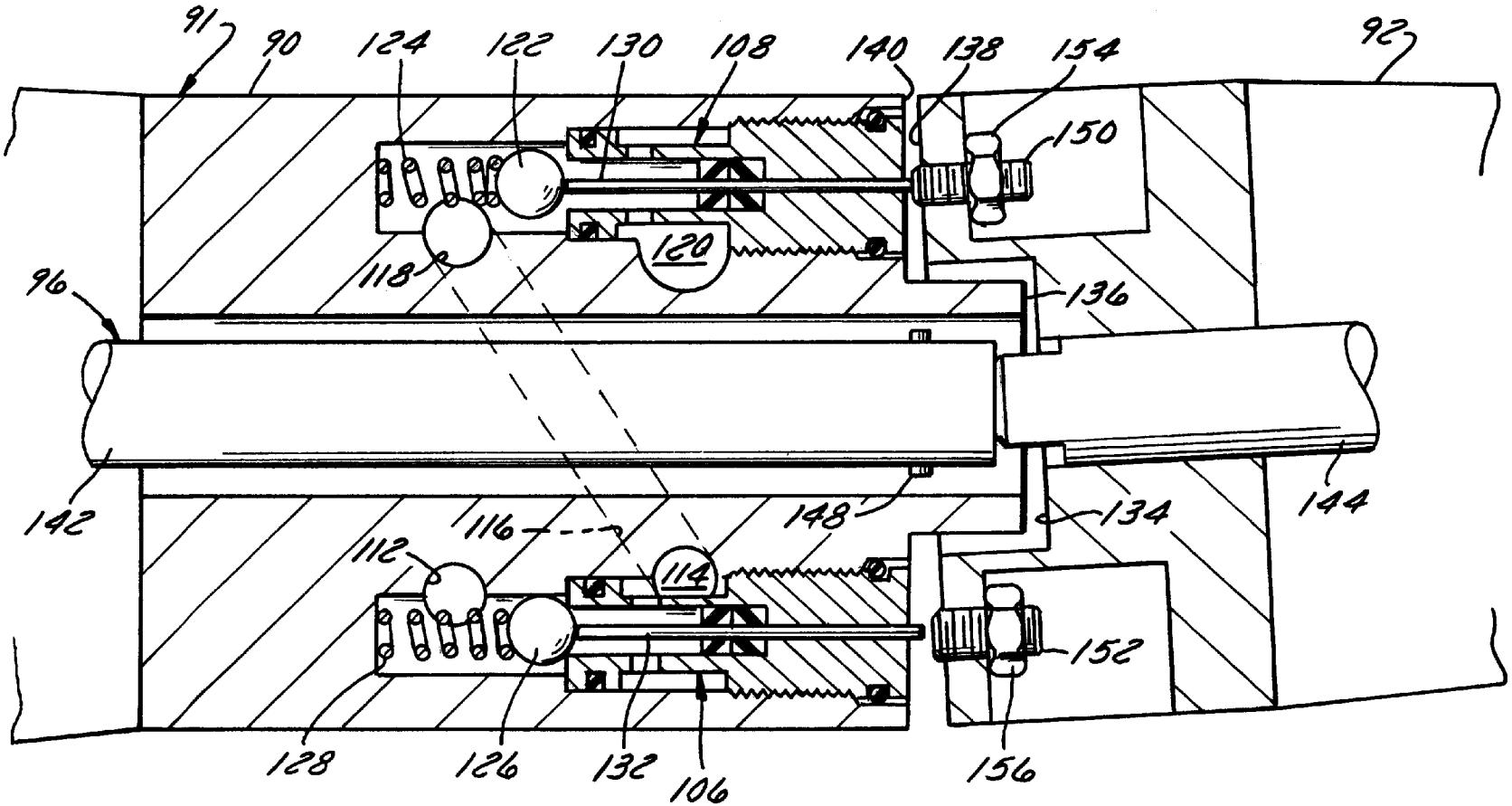
FIG. 7B corresponds to FIG. 7A and illustrates the hydraulic actuator in a second operational position thereof.

The control valve assembly 52 of this embodiment is mounted in a valve body 110 inserted into the tiller arm 91 proximate the outer end of the inner potion 90. Referring to FIGS. 5, 7A, and 7B, it includes a metering port 98 coupled to the second port 68 in the steering cylinder 54 via the metering line 70, a high pressure port 100 connected to the first port 64 in the steering cylinder 54 and to the pump outlet 88 via the split high pressure line 66, and a return port 102 connected to the inlet 89 of the reservoir 82 via a drain line 104. Fluid flow between the various ports is controlled by first and second mechanically actuated check valves 106, 108 located in a valve body 110. The first valve 106 is a high pressure or supply valve having an inlet 112 coupled to the high pressure port 100 and having an outlet 114 coupled to an internal metering passage 116 of the control valve assembly 52. The second valve 108 is a vent valve having an inlet 118 coupled to the metering passage 116 and an outlet 120 connected to the return port 102. The vent valve 108 includes a check ball 122 and a return spring 124 that biases the check ball 122 towards the outer end of the valve body 110. The supply valve 106 similarly includes a check ball 126 and return spring 128 that biases the check ball 126 toward the outer end of the valve body 110. The valves 108 and 106 are opened by axial movement of respective actuator pins 130, 132 that extend from the respective valve elements 122, 126, through associated axial bores in the valve body 110, and out of the outer end of the valve body 110. Both valves 106 and 108 are coupled to the actuator portion of the tiller 28, i.e., the articulating outer end 92 of the tiller arm 91, such that movement of the actuator portion 92 in a first direction opens one of the valves 106 or 108 while leaving the other valve closed, and movement of the actuator portion in a second direction opens the other valve 108 or 106 while leaving the one valve closed.

The articulation of the outer portion 92 of the tiller arm 91 to the inner portion 90 is illustrated in FIGS. 4, 6, 7A, and 7B. The outer portion 92 is counter-bored at its inner end to form a recess 134 for receiving a complimentary protrusion 136 on the outer end of the inner end portion 90. An inner end 138 of the outer portion 92 is normally spaced from an outer end 140 of the inner portion 90 by a relatively uniform gap G as seen in FIG. 7A. However, the recess 134 and the protrusion 136 are located radially and axially relative to one another to permit limited pivotal movement of the outer portion 92 relative to the inner portion 90 as seen in FIG. 7B. This pivoting movement is accommodated by a pivot mount formed by an articulation joint connecting inner and outer portions 142 and 144 of the throttle shaft 96. In the illustrated embodiments, the articulation joint comprises a ball 146 on the outer portion 144 and a cross pin 148 that is fixed to the inner portion 142 and that extends radially through the ball 146 so as to permit the ball 146 to rock back and forth about the pin 148 (compare FIG. 7A to FIG. 7B).

First and second threaded drive screws 150 and 152 are screwed into tapped axial bores in the outer portion 92 of the tiller arm 91 in alignment with the actuator pins 130 and 132. When the tiller arm outer portion 92 is pivoted in one direction or the other, the operative drive screw 150 or 152 drives the associated actuator pin 130 or 132 inwardly to open the associated valve 108 and 106. Each drive screw 150, 152 is held in position by a lock nut 154, 156 that permits the position of the drive screw relative to the inner end 138 of the tiller arm outer portion 92 to be varied in order to set a desired stroke of the associated actuator pin 130 or 132.

Figure 10:
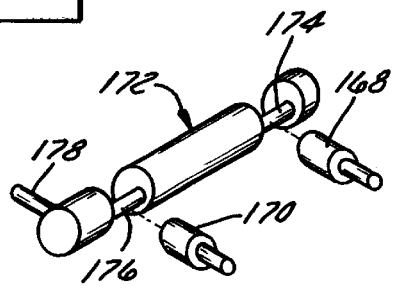
FIG. 10 is a perspective view of a portion of the adjustable biasing arrangement of FIGS. 9A and 9B.
Figure 8:
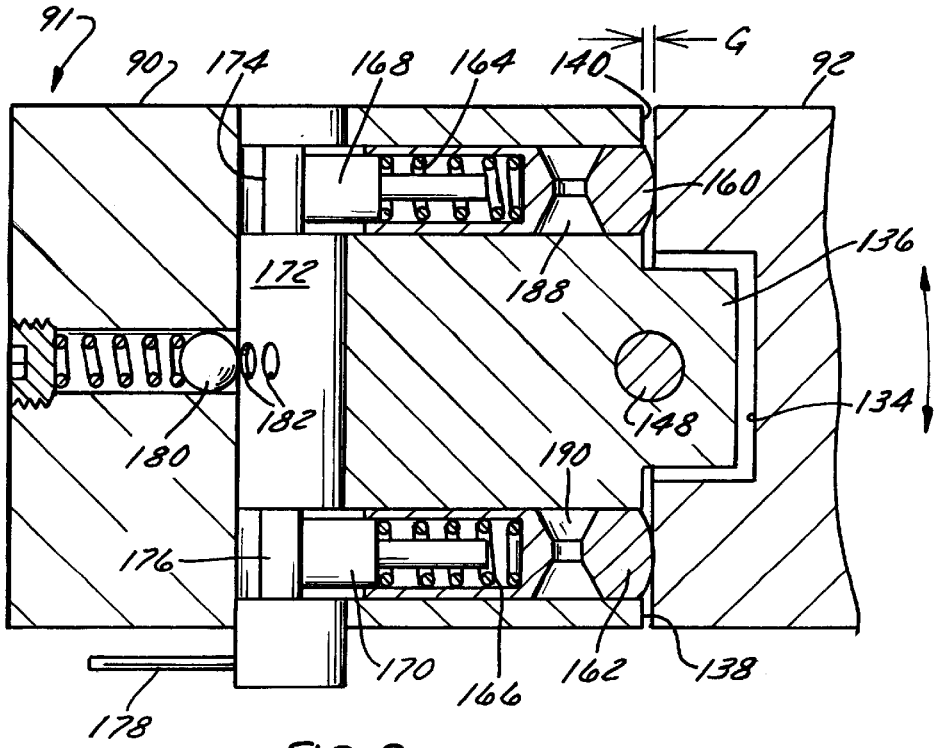
FIG. 8 is a sectional plan view taken generally along the lines 8—8 in FIG. 6.
Figure 9A:
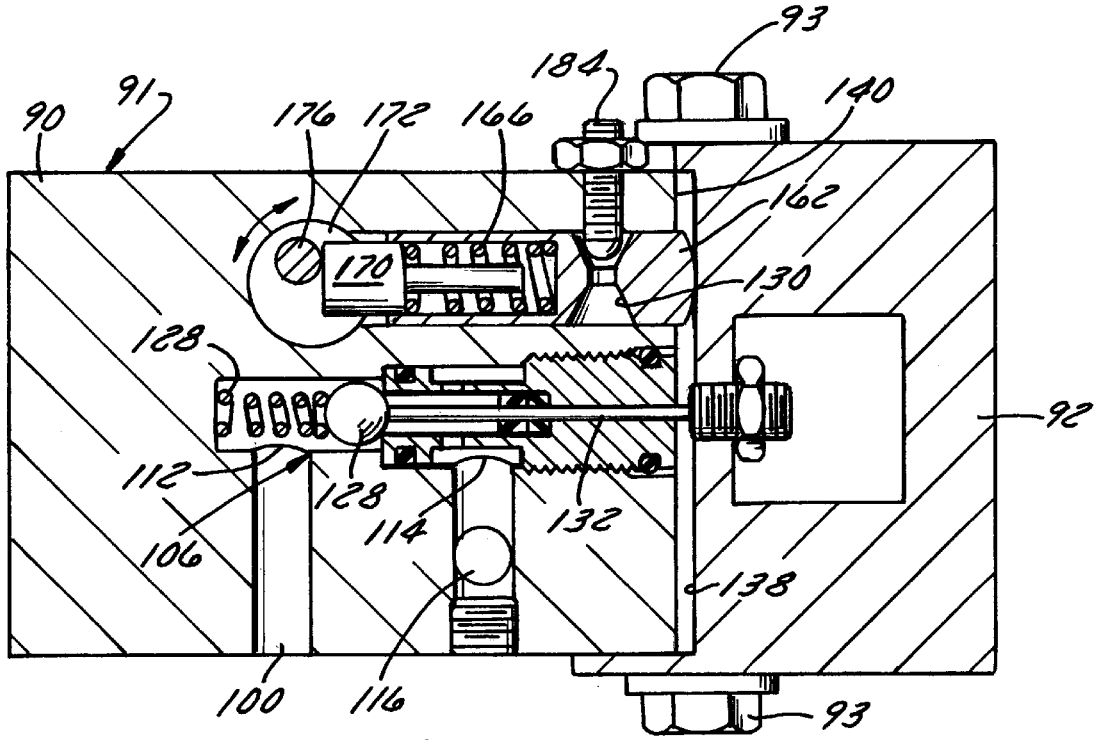
FIG. 9A is a sectional elevation view taken generally along the lines 9A—9A in FIG. 6 and illustrating an adjustable biasing arrangement of the hydraulic actuator in a first operational of thereof.
Figure 9B:
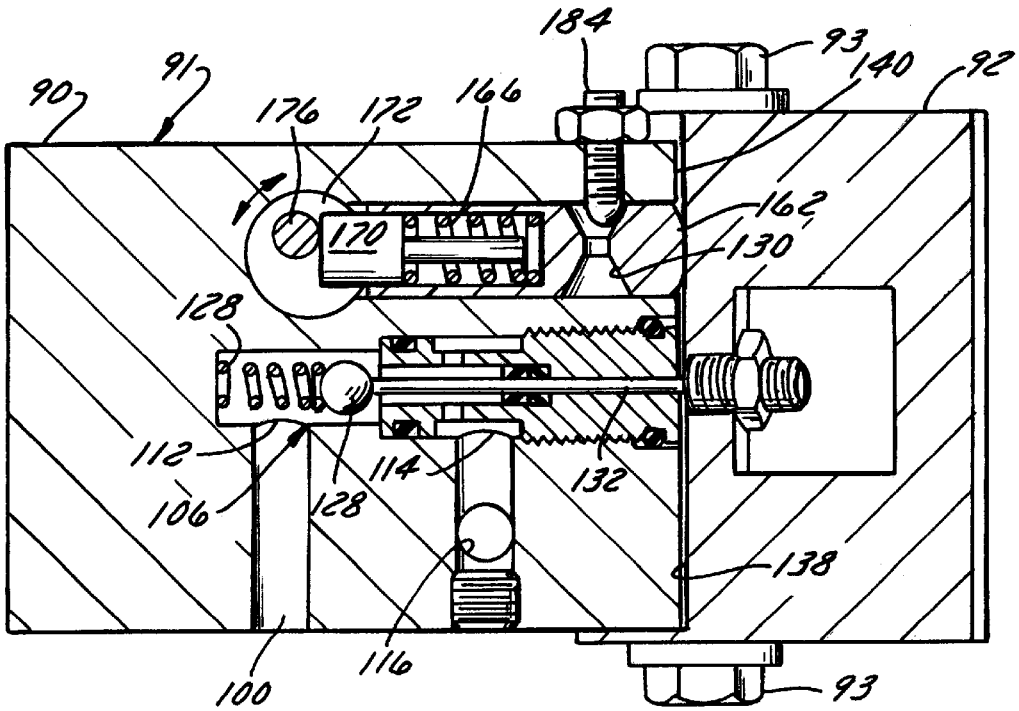
FIG. 9B corresponds to FIG. 9A and illustrates the adjustable biasing arrangement in a second operational position thereof.
Figure 11:
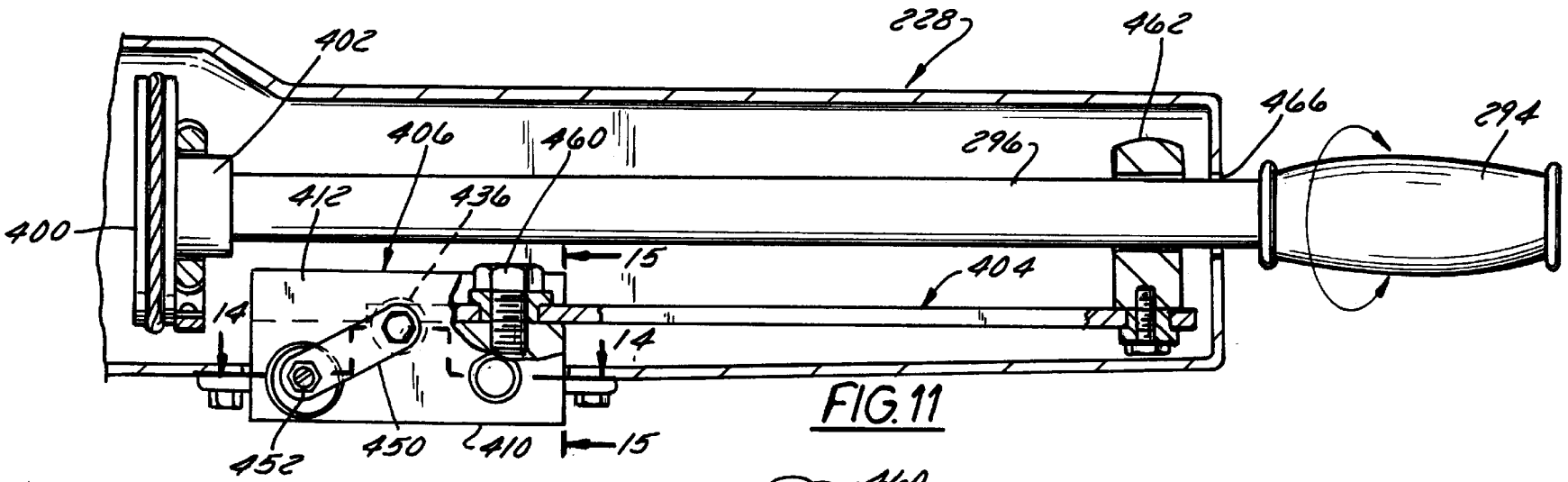
FIG. 11 is a somewhat schematic sectional side elevation view of a tiller operated power assist steering system constructed in accordance with a second preferred embodiment of the invention.

The tiller arm outer portion 92 is biased to its centered or neutral position of FIG. 7A to assure that the valves 106 and 108 are closed in the absence of tiller actuator portion manipulation. When the valves 106 and 108 are closed, fluid cannot flow to or from the steering cylinder 54, and the prevailing steering angle will be retained despite reaction forces on or by the motor 20. In the preferred embodiment, this biasing is obtained through operation of an adjustable biasing arrangement best seen in FIGS. 8–10. The biasing arrangement includes first and second plungers 160, 162 protruding outwardly from bores in the outer end of the tiller arm inner portion 90. Each plunger 160, 162 is biased into contact with the inner end 138 of the tiller arm outer portion 92 by a compression spring 164, 166, thereby biasing the tiller arm outer portion 92 to its neutral position. The magnitude of this biasing force can be adjusted by a cam assembly that adjusts the preload on the springs 164, 166. Specifically, the inner end of each spring 164, 166 is seated on a movable support pin 168, 170. Each support pin 168, 170, in turn, is seated on a reduced diameter seat portion 174, 176 of a cam shaft 172 extending laterally through the tiller arm inner portion 90. As best seen in FIGS. 8 and 10, the seat portions 174 and 176 of the cam shaft 172 are aligned with one another but are positioned off-center relative to the shaft's rotational axis. As a result, upon rotation of the cam shaft 172, the support pins 168, 170 move axially of the control valve assembly 52 to alter the preload on the springs 164, 166. Cam rotation is effected via a crank 178 mounted on a protrusion of the cam shaft 172 as best seen in FIG. 8. In order to provide the operator with a distinct feeling of adjustment and to inhibit undesired cam shaft rotation, a spring-loaded detent ball 180 may be provided for cooperation with a selected one of a plurality of recesses 182 in the periphery of the cam shaft 172 as best seen in FIG. 8. Finally, a stop screw 184, threaded through a tapped bore in the tiller arm inner portion 90 and radially into a mating recess 188, 190 in the associated plunger 160, 162, sets the neutral position of the tiller arm outer portion 92.

The operation of the pressurized hydraulic power assist steering system 10 will now be described, with the assumption that the hydraulic components are in the positions illustrated in FIG. 5 and the tiller arm 91 is in the position illustrated in FIG. 7A. At this time, both the supply and the vent valves 106 and 108 are closed to block the flow into or out of the metering passage 116. Pivoting movement of the tiller arm outer portion 92 in either direction relative to the tiller arm inner portion 90 drives the associated actuator pin 132 or 130 to open the associated valve 106 or 108. Hence, counterclockwise pivoting of the tiller arm actuator portion 92 from the position illustrated in FIG. 7A to the position illustrated in FIG. 7B moves the actuator pin 130 to drive the check ball 122 from its seat, permitting fluid to flow from chamber 60 of the steering cylinder 54, through port 68, through line 70, into passage 116, past check ball 122, past ports 120 and 102, into line 104, and back to the reservoir 82. At this time, fluid will flow from the pump 80, through line 66, and into chamber 58 of the steering cylinder 54. The resulting pressure differential across the steering cylinder piston 56 drives the rod 62 to the left, driving the steering linkage 30 to turn the boat 12 to the right. The only force required for this pivoting motion is the force required to overcome the friction in the pivot mount for the steering arm outer portion 92 and to overcome the biasing forces of the springs 164, 166. Hence, the actuating forces required for steering are dramatically reduced when compared to those that would be required for manual steering, permitting very large motors on the order of 150 horsepower and above to be easily steered using a tiller of standard length.

Conversely, if the operator pivots the tiller arm outer portion 92 clockwise, the actuator pin 132 forces the check ball 126 from its seat, fluid flows from chamber 58 of the steering cylinder 54 and from the pump 80, through line 66 into port 112, past check ball 126, into metering passage 116, through the line 70, and into the chamber 60 of the steering cylinder 54. The steering cylinder rod 62 extends (moves right), driving the steering linkage 30 to steer the boat left.

Regardless of the direction of tiller arm actuator portion pivoting, the steering cylinder rod extension or retraction and resultant change in steering angle will continue for so long as the operator continues to hold the tiller arm actuator portion 92 in its pivoted position relative to the remainder of the tiller arm 91. When the operator stops moving the actuator portion 92 relative to the remainder of the tiller arm 91, the steering cylinder piston 56 will continue to move the tiller arm 91 until the operative valve 106 or 108 closes to block further fluid flow to or from the steering cylinder 54. The return springs 164, 166 will then return the actuator portion 92 to its neutral position if the operator releases the tiller arm 91. The steering angle will thereafter remain unchanged, even if reaction forces are imposed on or by the motor 20 that would otherwise tend to increase or decrease the steering angle. The operator is therefore free to release the tiller 28 without fear of the steering angle changing.

In the event of hydraulic pressure loss or another event rendering the hydraulic power assist system inoperative, the boat 12 may still be steered manually simply by pivoting the tiller 28 as a whole to impose manual steering forces on the steering linkage 30 by pivoting the entire tiller arm 91 in the desired direction. Hence, steering control is assured.

3. Construction and Operation of the Second Embodiment

Figure 12:
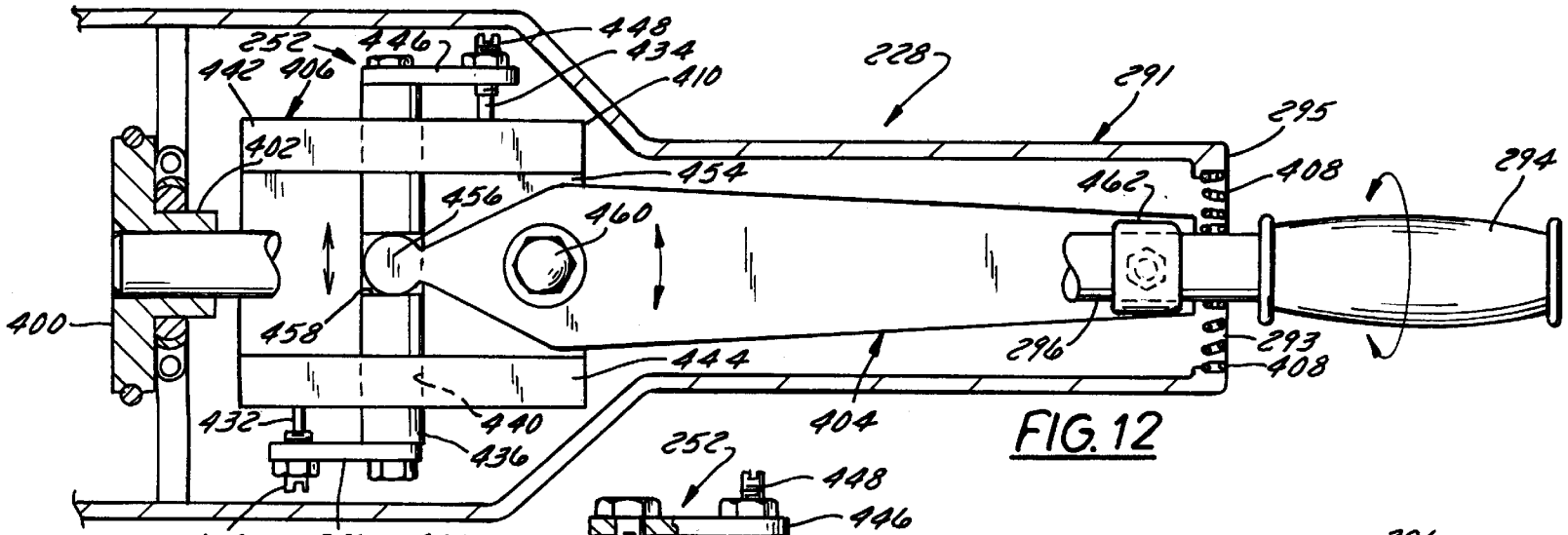
FIG. 12 is a sectional plan view of the steering system of FIG. 11.
Figure 15:
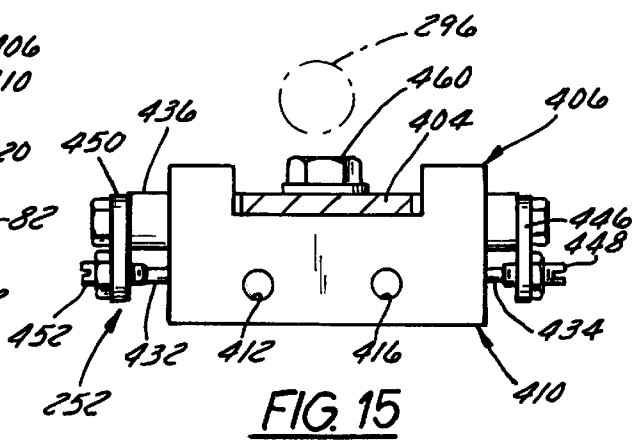
FIG. 15 is a sectional end elevational view taken generally along the lines 15—15 in FIG. 11.

Referring now to FIGS. 11–15, another pressurized hydraulic power assist steering system is illustrated that relies on pivoting of a movable throttle grip 294 of a tiller 228 to actuate the hydraulic actuator 252 rather than on pivoting one portion of an articulating tiller arm relative to another portion. The tiller 228 of this embodiment can be mechanically coupled to the same steering linkage 30 as in the first embodiment or otherwise operatively coupled to the motor 20 in any desired manner. It also can be used to control hydraulic fluid flow to and from the same unbalanced steering cylinder assembly 50 using the same pressure source 76 and a conceptually identical control valve assembly. In this embodiment, however, the tiller 228 is vertically stationary and does not articulate about any vertical pivot axis. In addition, the throttle shaft 296 does not articulate about a central portion thereof but, instead, is borne in the hub 402 of a throttle cable drive pulley 400 at its inner end in a manner that permits limited pivoting movement of the throttle shaft 296 relative to the remainder of the tiller 228 in the direction of the arrow in FIG. 12. In the preferred embodiment, the outer diameter of shaft 296 is sufficiently smaller than the inner diameter of the hub 402 to permit the shaft 296 to pivot within the hub 402 through a sufficient stroke to drive an actuator arm 404 to actuate a control valve assembly 406 mounted on the tiller 228. As in the first embodiment, the actuator portion of the tiller 228 (the throttle shaft 296 in this embodiment) is biased to a neutral position by a biasing arrangement. The biasing arrangement of this embodiment comprises a pair of springs 408 disposed in an elongated slot 293 in an outer end wall 295 of the tiller arm 291 on opposite sides of the throttle shaft 296 as best seen in FIG. 12.

Still referring to FIGS. 11–15, the control valve assembly 406 of this embodiment is housed in a valve body 410 bolted over an opening formed in the bottom of the tiller arm 291 and protruding outwardly from and beneath the pulley 400. It has a metering port 412, a high pressure port 414, and a return port 416 that are identical in operation to the corresponding ports of the control valve assembly of the first embodiment. It also includes a high pressure or supply valve 418, a vent valve 420, and an internal metering passage 422, all best seen in FIG. 14. As in the first embodiment, the metering passage 422 is normally separated from both the high pressure and return ports 414 and 416 but can be selectively coupled to either the high pressure port 414 or the return port 416 upon opening of either the supply valve 418 or the vent valve 420. Each valve 418 and 420 contains the same type of check ball 424, 426 and associated return spring 428, 430 as in the first embodiment. Also as in the first embodiment, each valve 418, 420 is opened by movement of a respective actuator pin 432, 434. However, the actuator pins 432, 434 are responsive to axial movement of a drive rod 436 as opposed to being directly responsive to pivoting movement of a tiller arm portion. Specifically, the actuator pins 432 and 434 extend laterally into opposed sides of the valve body 410. A drive rod 436, positioned longitudinally between the actuator pins 432 and 434, extends through aligned bores 438, 440 in opposed raised walls 442, 444 of the valve body 410. The valve walls 442 and 444 flank an upper recess 454 in the control valve body 410 that receives the actuator arm 404 as discussed below. A first link 446 is bolted to one end of the drive rod 436 and extends downwardly and outwardly in parallel with the outer surface of the valve body wall 442, and an adjustable drive screw 448 is mounted on the first link 446 in contact with the actuator pin 434. Similarly, a second link 450 is bolted to the opposite end of the drive rod 436 and extends downwardly and outwardly in parallel with the outer surface of the valve body wall 444, and a second adjustable drive screw 452 is mounted on the second link 450 in contact with the actuator pin 432. Actuator rod movement in one direction opens the supply valve 418 while leaving the vent valve 420 closed, thereby connecting the metering passage 422 to the pump outlet 88 as seen schematically in FIG. 14. Actuator rod movement in the opposite direction opens the vent valve 420 while leaving the supply valve 418 closed, connecting the metering passage 422 to the reservoir 82.

The actuator arm 404 is configured to translate pivoting motion of the throttle shaft 296 into axial movement of the drive rod 436. Specifically, the inner end of the actuator arm 404 terminates in a drive ball 456 that is seated in a socket 458 in the drive rod 436. The actuator arm 404 is pivotally attached to the upper surface of valve body 410 in front of the ball 456 by a screw 460. The outer end portion of the actuator arm 404 is coupled to the throttle shaft 296 by a yoke 462. As a result, pivoting movement of the throttle shaft 296 drives the actuator arm 404 to swing about the screw 460 and drive the drive rod 436 axially to open a corresponding one of the valves 418 or 420. The limit of this pivoting movement is determined by the clearance between the opposite sides of the throttle shaft 296 and the ends of the slot 293 in the tiller arm end wall 295.

A significant advantage of this embodiment relative to the first embodiment is that the relative axial spacing between the socket 458, the pivot bolt 460, and the grip 294 results in a smaller actuator stroke with a given amount of grip movement than in the first embodiment. This relationship reduces the response of the system to the point that mechanical vibrations and inadvertent operator contact are much less likely to result in an unintended steering operation than in the first embodiment. In addition, because the tiller arm 291 is one piece and the only movable part of the tiller is the relatively small throttle grip 294, there is a smaller chance of unintended steering through inadvertent contact with the tiller 28.

Figure 14:
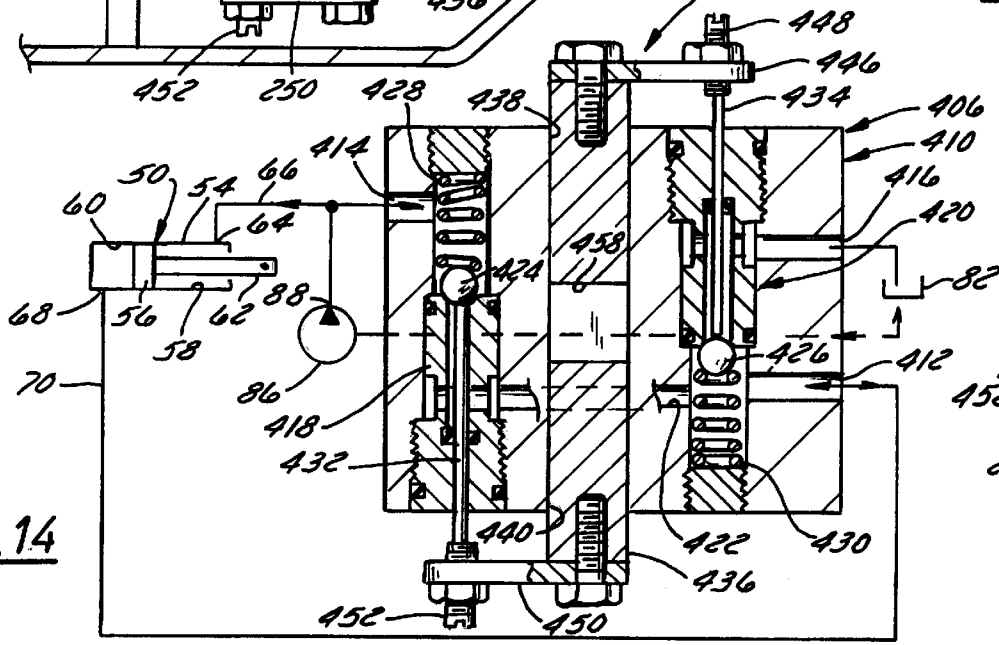
FIG. 14 is a view showing a sectional plan view of the control valve assembly of the steering system of FIGS. 11–13, taken generally along the lines 14—14 in FIG. 11, and also schematically showing other hydraulic components of the steering system.

In operation, the return springs 408 normally bias the throttle shaft 296 to the position illustrated in FIG. 12 in which the throttle shaft 296 and actuator arm 404 extend in parallel with a centerline of the tiller arm 291 and in which the drive rod 436 is centered within the valve body 410. Both valves 418 and 420 are closed at this time to isolate the second chamber 60 in the steering cylinder 54 from both the first chamber 58 and vent as seen in FIG. 14. As in the first embodiment, this isolation assures that the steering angle of the boat remains unchanged, even upon the imposition of reaction forces on the steering cylinder assembly 50 on or by the motor.

If the operator wishes to steer the boat to the right, he or she simply pivots the throttle shaft 296 counterclockwise relative to the tiller arm 291 or up in FIG. 12, thereby driving the drive rod 436 to move to the left or downwardly in FIG. 12. This movement drives the actuator pin 434 into engagement with the check ball 426 to connect the metering port 412 and the steering cylinder chamber 60 to vent. The rod 62 will retract in response to the resulting pressure differential across the piston 56 and the fluid flow into the chamber 58 from the pump 86, thereby steering the boat to the right. When the operator stops moving the grip 294, the steering cylinder piston will continue to move the tiller arm 291 until the control valve assembly components return to the positions illustrated in FIGS. 12 and 14, thereby isolating the chambers 58 and 60 of the steering cylinder 54 from one another and arresting further steering cylinder rod retraction. As before, the steering cylinder rod 62 and motor remain in this position despite the imposition of reaction forces on or by the motor. Also as before, the springs 408 will return the throttle shaft 296 to its neutral position when the operator releases the grip 294.

Figure 13:
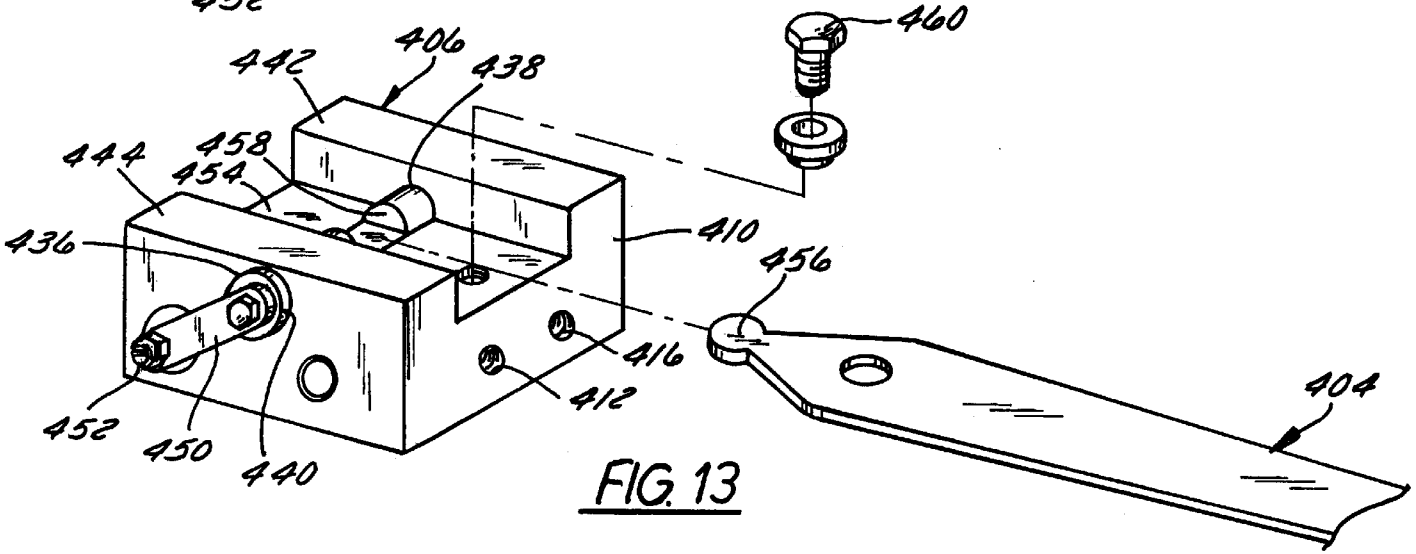
FIG. 13 is an exploded perspective view of a portion of the steering system of FIGS. 11 and 12, including a control valve assembly and an actuator arm.

The boat can be steered to the left by grasping the grip 294 and pivoting the throttle shaft 296 clockwise or down in FIGS. 12 and 13, thereby driving the actuator arm 404 to the inner end right or up in those figures. As a result, the actuator pin 432 opens the high pressure valve 418 to connect the metering passage 422 and the chamber 60 to the pump outlet 88 and the chamber 58 of the steering cylinder 54, hence causing the unbalanced piston 56 to move to the right to extend the rod 62 and steer the boat to the left. Once again, when the operator stops moving the throttle shaft 296 relative to the remainder of the tiller 228, the components will return to their center or neutral position to maintain the boat at the then-prevailing steering angle despite the imposition of reaction forces on or by the motor.

As in the first embodiment, throttle grip movement beyond the stroke described above will result in movement of the tiller 228 as a whole, hence imposing manual steering forces to the tiller 228. These forces are transmitted back to the motor through the steering linkage. These manual forces supplement the hydraulically-generated steering forces imposed by the steering cylinder assembly 50 during normal operation. These manual forces may also be used to permit manual steering of the boat in the event of failure of the pump 80 or some other hydraulic component of the steering system.

Many changes and modifications could be made to the invention without departing from the spirit thereof. For instance, a variety of different mechanisms are available for imposing power assist steering forces on a motor or other steered element upon manipulation of a tiller in the first manner and of imposing manually generated steering forces on that steered element upon manipulation of the tiller in a second manner. Moreover, while it is desirable to retain the ability to steer the boat manually, manual steering capability is not critical to the invention. Hence, operating the tiller in first and second manners is not critical. It is also conceivable that drive mechanism actuation could be achieved by movement other than one portion of the tiller relative to another. For instance, in the first embodiment, the articulation point of the system could be located in the steering linkage 30 rather than in the tiller 28, whereby initial tiller movement would pivot an outer portion of the steering linkage 30 relative to an inner portion to actuate the steering cylinder assembly 50 or other drive mechanism. The scope of some of these changes can be appreciated by comparing the various embodiments as described above. The scope of the remaining changes will become apparent from the appended claims.

I claim:

1. A power steering assist system for a watercraft, comprising:

(A) a tiller which is configured to be operatively coupled to a steered element of a watercraft so as to impose manually-generated steering forces on the steered element upon manipulation of the tiller in a first manner;

(B) a drive mechanism which is configured to be operatively coupled to the steered element; and (C) an actuator which is connected to said drive mechanism and to said tiller and which is operable, upon manipulation of said tiller in a second manner, to effect actuation of said drive mechanism to impose power-assisted steering forces on the steered element.

2. The steering system as recited in claim 1, wherein said tiller comprises an actuator portion which is movable relative to the remainder of said tiller, and wherein said tiller cooperates with said actuator and is configured to cooperate with the steered element such that said tiller operates in said first manner when said tiller moves as a unit and operates in said second manner when said actuator portion moves relative to the remainder of said tiller.

3. The power assist steering system as recited in claim 2, wherein said tiller comprises:

a tiller arm which is configured to be mechanically coupled to the steered element so as to steer the steered element upon pivotal movement thereof, and a throttle grip which is mounted on said tiller arm, which forms said actuator portion, and which is movable through a limited stroke relative to said tiller arm to operate a hydraulic actuator.

4. The steering system as recited in claim 3, wherein said steering system comprises a hydraulic power assist steering system, said drive mechanism comprises a steering cylinder assembly, and said actuator comprises a hydraulic actuator that comprises:

a control valve assembly which controls hydraulic fluid flow to and from said steering cylinder assembly, a first valve actuator which cooperates with said control valve assembly and which is driven from a deactuated position thereof to an actuated position thereof upon movement of said throttle grip in a first direction from a neutral position thereof, and a second valve actuator which cooperates with said control valve assembly and which is driven from a deactuated position thereof to an actuated position thereof upon movement of said throttle grip in a second direction from said neutral position thereof.

5. The steering system as recited in claim 4, wherein said first and second valve actuators comprise first and second actuator pins extending into a valve housing of said control valve assembly.

6. The steering system as recited in claim 4, wherein said tiller further comprises a throttle shaft that transmits throttle actuation forces from said throttle grip to a throttle actuator, and wherein said hydraulic actuator further comprises an actuator arm which extends at least generally in parallel with said throttle shaft and which is coupled to said throttle shaft so as to actuate said valve actuators upon pivotal movement of said throttle shaft from said neutral position thereof.

7. The steering system as recited in claim 6, wherein said first and second valve actuators comprise first and second actuator pins extending into a valve housing of said control valve assembly, and wherein said actuator arm is pivotally mounted on said valve housing at a location between said first and second actuator pins and an outer end of said actuator arm.

8. The steering system as recited in claim 6, further comprising a biasing arrangement which biases said throttle shaft toward said neutral position.

9. The steering system as recited in claim 1, wherein said steering system is a hydraulic power assist steering system, said drive mechanism comprises a steering cylinder assembly, and said actuator comprises a hydraulic actuator.

10. The steering system as recited in claim 9, wherein said steering system is a pressurized hydraulic power assist steering system.

11. The steering system as recited in claim 10, further comprising a pump and a reservoir, and wherein said hydraulic actuator comprises a control valve assembly which is hydraulically coupled to said pump and said steering cylinder assembly and which is mechanically coupled to said actuator portion of said tiller so as to control fluid flow between said steering cylinder assembly and said pump and between said steering cylinder assembly and said reservoir in response to movement of said actuator portion of said tiller relative to the remainder of said tiller.

12. The steering system as recited in claim 11, wherein said control valve assembly comprises a first valve which selectively couples said steering cylinder to said pump and a second valve which selectively couples said steering cylinder assembly to said reservoir, and wherein said actuator portion of said tiller is coupled to said control valve assembly such,that movement of said actuator portion in a first direction from a neutral position thereof opens said first valve and movement of said actuator portion in a second direction from said neutral position opens said second valve.

13. The steering system as recited in claim 12, wherein said actuator portion of said tiller is coupled to said control valve assembly such that both said first and second valves are closed when said actuator portion of said tiller is in said neutral position.

14. The steering system as recited in claim 11, wherein said tiller comprises an articulating tiller arm having an inner portion that is configured to be mechanically coupled to the steered element so as to steer the steered element upon pivotal movement thereof and having an outer portion which forms said actuator portion and which is pivotable through a limited stroke relative to said inner portion to actuate said control valve assembly.

15. The steering system as recited in claim 11, wherein said tiller comprises a tiller arm which is configured to be mechanically coupled to the steered element so as to steer the steered element upon pivotal movement thereof and a throttle grip which forms said actuator portion, which is mounted on said tiller arm, and which is movable through a limited stroke relative to said tiller arm to actuate said control valve assembly.

16. The steering system as recited in claim 9, wherein said tiller comprises an articulating tiller arm having an inner portion which is configured to be mechanically coupled to the steered element so as to steer the steered element upon pivotal movement thereof and an outer portion which forms said actuator portion and which is pivotable through a limited stroke relative to said inner portion to operate said hydraulic actuator.

17. The steering system as recited in claim 16, wherein said hydraulic actuator comprises a control valve assembly which controls hydraulic fluid flow to and from said steering cylinder assembly, a first valve actuator which cooperates with said control valve assembly, which is located on a first side of a pivot point of said outer portion of said tiller arm, and which is driven from a deactuated position thereof to an actuated position thereof upon pivoting movement of said outer portion of said tiller arm in a first direction from a neutral position thereof, and a second valve actuator which cooperates with said control valve assembly, which is located on a second side of said pivot point of said outer portion, and which is driven from a deactuated position thereof to an actuated position thereof upon pivoting movement of said outer portion of said tiller arm in a second direction from said neutral position thereof.

18. The hydraulic assist steering system as recited in claim 17, wherein said first and second valve actuators comprise first and second actuator pins extending into a valve housing of said control valve assembly.

19. The hydraulic assist steering system as recited in claim 17, further comprising a biasing arrangement which biases said outer portion of said tiller arm to said neutral position.

20. The steering system as recited in claim 1, wherein the steered element is an outboard motor which is pivotally mounted on a hull of the watercraft.

21. A hydraulic power assist steering assist system for a watercraft, comprising:

(A) a tiller arm which is configured to be mechanically coupled to a pivotable motor of a watercraft so as to impose manually-generated steering forces on the motor upon pivotal movement thereof;

(B) a steering cylinder which is configured to be operatively coupled to the motor so as to impose steering forces on the motor upon extension or retraction thereof;

(C) a throttle grip which is supported on said tiller arm so as to rotate and to pivot relative to said tiller arm; and (D) a hydraulic actuator which is connected to said steering cylinder and said throttle grip and which is operable, upon pivotal movement of said throttle shaft relative to said tiller arm, to effect hydraulic actuation of said steering cylinder to impose hydraulically-generated steering forces on the motor.

22. The steering system as recited in claim 21, wherein said steering system is a pressurized hydraulic power assist steering system, wherein said hydraulic actuator further comprises a pump, a reservoir, and a control valve assembly which controls fluid flow between said steering cylinder, said pump, and said reservoir.

23. A method comprising:

moving at least a portion of a tiller to operate a drive mechanism so as to impose power assist steering forces on a steered element of a watercraft.

24. The method as recited in claim 23, wherein the moving step comprises moving a first portion of said tiller relative to a second portion of said tiller.

25. The method as recited in claim 24, further comprising moving said first and second portions of said tiller as a unit to impose manually-generated steering forces on said steered element.

26. The method as recited in claim 24, wherein the moving step comprises pivoting an outer portion of a tiller arm of said tiller relative to an inner portion of said tiller arm.

27. The method as recited in claim 24, wherein the moving step comprises moving a throttle grip of said tiller relative to a tiller arm on which said throttle shaft is mounted.

28. The method as recited in claim 24, wherein the power assist steering forces are hydraulically-generated power assist steering forces imposed on said steered element by directing hydraulic fluid to and from a steering cylinder which is mechanically coupled to said steered element.

29. The method as recited in claim 28, wherein the hydraulically-generated steering forces are imposed on said steered element by directing pressurized hydraulic fluid to and from said steering cylinder.

30. A method comprising:

(A) manually moving a throttle grip of a tiller relative to a tiller arm of said tiller to control the flow of hydraulic fluid to and from a steering cylinder; and (B) in response to the flow of hydraulic fluid to and from said steering cylinder, extending and retracting said steering cylinder to impose hydraulically-generated power assist steering forces on a motor which is pivotally mounted on a watercraft and to which said steering cylinder is mechanically coupled.

31. The method as recited in claim 30, wherein said tiller arm is mechanically coupled to said motor, and further comprising manually pivoting said tiller arm to impose manually-generated steering forces on said motor.

32. A power steering assist system for a watercraft, comprising:

(A) a tiller;

(B) a drive mechanism which is configured to be operatively coupled to a steered element of the watercraft; and (C) an actuator which is connected to said drive mechanism and to said tiller and which is operable, upon manipulation of said tiller, to effect actuation of said drive mechanism to impose power-assisted steering forces on the steered element.

33. The power assist steering system as recited in claim 32, wherein a first portion of said tiller is movable relative to a second portion thereof, and wherein said tiller is coupled to said actuator such that said tiller actuates said actuator upon movement of said first portion of said tiller relative to said second portion.

34. The power assist steering system as recited in claim 33, wherein said tiller is configured to be operatively coupled to the steered element so as to impose manually-generated steering forces on the steered element upon movement of the tiller as a unit.

* * * * *